United States Patent [19]

Gruber et al.

[11] Patent Number: 4,604,338

[45] Date of Patent: Aug. 5, 1986

[54] POSITIVELY CHARGED COLORED TONER COMPOSITIONS

[75] Inventors: Robert J. Gruber, Pittsford; Raymond A. Yourd, III, Rochester; Ronald J. Koch, Webster, all of N.Y.

[73] Assignee: Xerox Corporation, Stamford, Conn.

[21] Appl. No.: 764,024

[22] Filed: Aug. 9, 1985

[51] Int. Cl.[4] ..... G03G 9/08; G03G 9/10

[52] U.S. Cl. ..... 430/106; 430/108; 430/109; 430/110

[58] Field of Search ..... 430/106, 109, 110

[56] References Cited

U.S. PATENT DOCUMENTS

| | | | |
|---|---|---|---|
| 3,079,342 | 2/1963 | Insalaco . | |
| 4,148,741 | 4/1979 | Bayley . | |
| 4,329,415 | 5/1982 | Ikeda et al. | 430/109 |
| 4,362,803 | 12/1982 | Miyakawa et al. | 430/122 |
| 4,367,275 | 1/1983 | Aoki et al. | 430/99 |
| 4,385,107 | 5/1983 | Tanaka et al. | 430/98 |
| 4,460,672 | 7/1984 | Gruber et al. | 430/110 |
| 4,513,074 | 4/1985 | Nash et al. | 430/106.6 |
| 4,556,624 | 12/1985 | Gruber et al. | 430/109 X |

*Primary Examiner*—Roland E. Martin
*Attorney, Agent, or Firm*—E. O. Palazzo

[57] ABSTRACT

Disclosed is an improved positively charged dry electrostatic colored toner composition comprised of first resin particles; crosslinked second resin particles; colored pigment particles excluding black; and selected from the group consisting of cyan, magenta, yellow, blue, red, and brown; a low molecular weight wax; and a charge enhancing additive selected from the group consisting of alkyl pyridinium halides, organic sulfonate compositions and organic sulfate compositions of the following formulas:

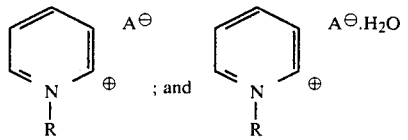

I.

wherein R is a hydrocarbon group containing from about 8 to about 22 carbon atoms, and A is an anion;

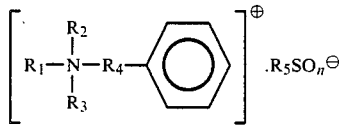

II.

wherein $R_1$ is an alkyl group of from about 12 carbon atoms to about 22 carbon atoms, $R_2$ and $R_3$ are independently selected from alkyl groups containing from about 1 carbon atom to about 5 carbon atoms, $R_4$ is an alkylene group of from about 1 carbon atom to about 5 carbon atoms, $R_5$ is a tolyl group or an alkyl group of from about 1 carbon atom to about 3 carbon atoms, and n is the number 3 or 4; and distearyl dimethyl ammonium methyl sulfate, behenyl trimethyl ammonium methyl sulfate, and distearyl methyl ethyl ammonium ethyl sulfate.

27 Claims, No Drawings

POSITIVELY CHARGED COLORED TONER COMPOSITIONS

BACKGROUND OF THE INVENTION

This invention is generally directed to toner and developer compositions. More specifically, the present invention is directed to positively charged colored toner compositions containing a low molecular weight wax such as polyethylene or polypropylene, and a charging enhancing additive. These compositions are particularly useful for permitting the development of colored images in electrostatographic imaging processes wherein an offset preventing liquid, such as silicon oil is not required.

Developer compositions with charge enhancing additives, especially additives which impart a positive charge to the toner resin, are well known. Thus, for example, there is described in U.S. Pat. No. 2,986,521 reversal developer compositions comprised of toner resin particles coated with finely divided colloidal silica. According to the disclosure of this patent the development of electrostatic latent images on negatively charged surfaces is accomplished by applying a developer composition having a positively charged triboelectric relationship with respect to the colloidal silica. Additionally, in U.S. Pat. No. 3,893,935 there is described the utilization of certain quaternary ammonium salts as charge control agents for electrostatic toner compositions. There is also described in U.S. Pat. No. 4,298,672 positively charged toner compositions with resin particles and pigment particles; and as a charge enhancing additive alkyl pyridinium compounds and their hydrates, inclusive of cetyl pyridinium chloride.

Generally, the aforementioned prior art developer compositions are selected for use in developing electrostatic images wherein the toner image is fixed to a permanent substrate, such as paper, by contacting the paper with a roller, the surface of which is formed from a material capable of preventing toner particles from sticking thereto. In this process, however, the surface of the fixing roll is brought into contact with the toner image in a hot melt state, thus a part of the toner image can adhere to and remain on the surface of the fixing roll. This enables a part of the toner image to be transferred back onto the surface of a subsequent sheet thereby resulting in the well known undesirable offset phenomena.

To substantially eliminate offsetting, and more specifically for the purpose of preventing adhesion of the toner particles to the surface of the fixing roller, there have been selected certain types of rollers, the surface of which may be covered with a thin film of an offset preventing liquid such as a silicone oil. These oils are highly effective, however, the apparatus within which they are incorporated is complicated and costly since, for example, a means for feeding the oil is required. Also, not only do the silicone oils emit an undesirable odor, they can deposit on machine components causing toner particles to adhere to the oils. An accumulation of toner particles on machine components is troublesome in that the image quality is adversely effected, and further these components must be periodically cleaned and/or replaced adding to the maintenance costs thereof. The aforementioned offsetting problems can be substantially eliminated with the black and magnetic toner compositions as disclosed in U.S. Pat. No. 4,460,672. This patent, the disclosure of which is totally incorporated herein by reference, illustrates positively charged toner compositions comprised of resin particles, pigment particles, a low molecular weight wax material, and a charge enhancing additive. More specifically, in one embodiment the U.S. Pat. No. '672 patent discloses a positively charged black toner composition comprised of resin particles containing polyester resins, styrene butadiene resins, or styrene butyl methacrylate resins; pigment particles; a low molecular weight waxy composition, such as a low molecular weight polyethylene or polypropylene; and a charge enhancing additive selected from the group consisting of alkyl pyridinium halides, organic sulfonate additives and organic sulfate additives. Also, there is described in copending application U.S. Ser. No. 655,381, now U.S. Pat. No. 4,556,624, entitled Toner Compositions With Crosslinked Resins and Low Molecular Weight Waxes, the disclosure of which is totally incorporated herein by reference, positively charged electrostatic toner compositions comprised of a polyblend mixture of a crosslinked copolymer composition, a second thermoplastic polymer, pigment particles, a charge enhancing additive, and a wax component. The aforementioned compositions are useful for affecting the development of images wherein offset preventing liquid such as a silicone oil is not required. Accordingly, the compositions of the present application are similar to those illustrated in the copending application with the primary exception that there is selected for the present invention colored pigment particles excluding carbon black.

There, however, continues to be a need for colored positively charged toner and developer compositions which are useful in electrostatographic imaging systems. More specifically, there is a need for improved positively charged colored toner compositions, which can be selected for permitting the development of electrostatic latent images in electrostatographic devices wherein offset preventing liquids such as silicone oils are not required. There is also a need for colored toner compositions wherein imaging is accomplished with coated hard fuser rolls, and wherein substantially no offsetting results.

SUMMARY OF THE INVENTION

It is an object of the present invention to provide colored toner compositions, and developer compositions.

In another object of the present invention there is provided positively charged colored toner compositions which can be used in electrostatographic imaging systems without silicon oil release fluids.

In yet another object of the present invention there is provided positively charged colored toner compositions with low molecular weight waxes such as polyethylene and polypropylene, and charge enhancing additives.

It is an additional object of the present invention to provide methods for developing electrostatographic images with positively charged colored toner compositions, and wherein a silicone oil releasing fluid is not needed for preventing toner offset to the fuser rolls.

These and other objects of the present invention are accomplished by providing developer compositions; and positively charged colored toner compositions comprised of resin particles, colored pigment particles, a low molecular weight wax and a charge enhancing additive. More specifically, in one embodiment the present invention is directed to positively charged colored toner compositions comprised of first resin particles; crosslinked second resin particles; colored pigment particles other than black, and selected from the group consisting of cyan, magenta, yellow, blue, red, brown, and green; a low molecular weight polyethylene or polypropylene composition; and a charge enhancing additive selected from the group consisting of alkyl pyridinium halides I, organic sulfonate additives and organic sulfate additives II of the following formulas:

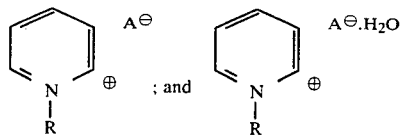

I.

wherein R is a hydrocarbon group containing from about 8 to about 22 carbon atoms, and preferably from 12 to 18 carbon atoms; and A is an anion preferably selected from halides such as chloride, bromide, iodide, sulfate, sulfonate, nitrate, or borate;

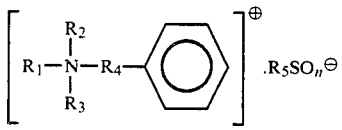

II.

wherein $R_1$ is an alkyl group containing from about 12 carbon atoms to about 22 carbon atoms, and preferably from about 14 carbon atoms to 18 carbon atoms, $R_2$ and $R_3$ are independently selected from alkyl groups containing from about 1 carbon atom to about 5 carbon atoms, $R_4$ is an alkylene group containing from about 1 carbon atom to about 5 carbon atoms, $R_5$ is a tolyl group or an alkyl group containing from about 1 carbon atom to about 3 carbon atoms, and n is the number 3 or 4; and sulfate charge enhancing additives selected from the group consisting of distearyl dimethyl ammonium methyl sulfate, behenyl trimethyl ammonium methyl sulfate, and distearyl methyl ethyl ammonium ethyl sulfate, reference U.S. Ser. No. 645,660, now U.S. Pat. No. 4,560,635, entitled Toner Compositions With Ammonium Sulfate Charge Enhancing Additives, the disclosure of which is totally incorporated herein by reference. Also, the alkyl pyridinium halides are described in U.S. Pat. No. 4,298,672, the disclosure of which is totally incorporated herein by reference; and the sulfates and sulfonates, reference Formula II, are illustrated in U.S. Pat. No. 4,338,390, the disclosure of which is totally incorporated herein by reference.

Illustrative examples of hydrocarbon radicals for R, reference Formula I, include octyl, nonyl, decyl, myristyl, cetyl, oleyl, pentadecyl, heptadecyl, and octadecyl. Specific illustrative examples of alkyl pyridinium compounds include cetyl pyridinium chloride, heptadecyl pyridinium bromide, octadecyl pyridinium chloride, myristyl pyridinium chloride, and the corresponding hydrates.

Illustrative examples of alkyl groups for the compositions embraced by Formula II are methyl, ethyl, propyl, butyl, pentyl, hexyl, octyl, nonyl, decyl, myristyl, cetyl, oleyl, pentadecyl, heptadecyl, stearyl and the like. Preferred alkyl groups for $R_1$ include myristyl, stearyl, and cetyl, while preferred alkyl groups for $R_2$, $R_3$ and $R_5$ are methyl, ethyl and propyl. The preferred alkylene groups for $R_4$ are methylene and ethylene.

Specific illustrative examples of Formula II organic sulfonates and sulfates are stearyl benzyl ammonium para-toluene sulfonate, stearyl dimethyl phenethyl ammonium methyl sulfonate, stearyl dimethyl phenethyl ammonium para-toluene, sulfonate, cetyl diethyl benzyl ammonium methyl sulfate, myristyl dimethyl penethyl ammonium para-toluene sulfonate, and cetyl diethyl benzyl ammonium methylsulfate.

Examples of first resins useful for the toner compositions of the present invention include polyesters, diolefin polymers, styrene/methacrylate resins, polyamides, epoxies, polyurethanes, vinyl resins and polymeric esterification products of a dicarboxylic acid and a diol comprising a diphenol. Suitable vinyl resins include homopolymers or copolymers of two or more vinyl monomers. Examples of vinyl monomeric units are styrene, p-chlorostyrene, vinyl naphthylene, vinyl chloride, ethylenically unsaturated mono-olefins such as ethylene, propylene, butylene, isobutylene and the like; vinyl esters such as vinyl acetate, vinyl propionate, vinyl benzoate, and vinyl butyrate; esters of alphamethylene aliphatic monocarboxylic acids inclusive of methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, and acrylamide; vinyl ethers such as vinyl methyl ether, vinyl isobutyl ether, and vinyl ethyl ether; vinyl ketones like vinyl methyl ketone, vinyl hexyl ketone, and methyl isopropenyl ketone; styrene butadiene copolymers; and mixtures thereof.

Specific preferred toner resins are selected from polystyrene methacrylate resins, polyester resins such as those described in U.S. Pat. Nos. 3,655,374, and 3,590,000, the disclosures of which are totally incorporated herein by reference, polyester resins resulting from the condensation of dimethylterephthalate, 1,3 butanediol, and pentaerythritol, and the styrene butadiene copolymer Pliolite resins which are commercially available from Goodyear Corporation as S5A. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent. A specific styrene butadiene resin found highly useful in the present invention is comprised of about 89 percent of styrene, and 11 percent of butadiene.

Examples of second resin particles include the aforementioned polymers illustrated herein with reference to the first resin particles with the exception that these resins are crosslinked with various crosslinking compositions including aromatic and nonaromatic substances such as divinyl benzene, ethylene glycol, dimethyl acrylate, and the like. It is important that the second resin particles be crosslinked to enable undesirable offsetting of the toner image to the fuser rolls, extended fuser wearability, and improved release characteristics associated with the transfer of the developed image from the imaging member to a suitable substrate such as paper. Preferred toner resins, which are subsequently crosslinked, that are selected are polystyrene methacrylates, polyesters such as those described in U.S. Pat. Nos. 3,655,374, and 3,590,000, polyester resins resulting from the condensation of dimethyl terephthalate 1,3 butanediol, and pentaerythritol; and Pliolite resins. Related copending application U.S. Ser. No. 655,381, now U.S. Pat. No. 4,556,624, entitled Toner Compositions With Crosslinked Resins and Low Molecular Weight Wax Compositions, the disclosure of which has been totally incorporated herein by reference, details, for example crosslinked polymeric compositions that may be selected for the second resin particles of the present application.

As colored pigment particles that may be incorporated into the toner particles, there are selected cyan, magenta, yellow, red, blue, brown and green. These pigments are generally present in the toner composition in an amount of from about 2 weight percent to about 15 weight percent based on the weight of the toner resin particles.

Illustrative examples of magenta, cyan and yellow pigments, or colorants selected for the toner compositions of the present invention are well known including, for example, the magenta compounds 2,9-dimethyl-substituted quinacridone and anthraquinone dye identified in the color index as Cl 60710; Cl Dispersed Red 15, a diazo dye identified in the color index as Cl 16050; Cl Solvent Red 19; and the like. Examples of cyan materials that may be used as pigments include copper tetra-4(octadecyl sulfonamido)phthalocyanine; X-copper phthalocyanine pigment listed in the color index as Cl 74160; Cl Pigment Blue; and Anthrathrene Blue, identified in the color index as Cl 69810; Special Blue X-2137, and the like; while illustrative examples of yellow pigments that may be selected include diarylide yellow, 3,3-dichlorobenzidene acetoacetanilides; a monoazo pigment identified in the color index as Cl 12700; Cl Solvent Yellow 16; a nitrophenyl amine sulfonamide identified in the color index as Foron Yellow Se/GLN; Cl Dispersed Yellow 33, 2,5-dimethoxy-4-sulfonanilide phenylazo-4'-chloro-2,5-dimethoxy acetoacetanilide; and Permanent Yellow FGL.

The waxy substances incorporated into the colored toner composition generally has a molecular weight of from between about 500 to about 20,000, and preferably is of a molecular weight of from about 1,000 to about 6,000. Illustrative examples of low molecular weight waxy materials included within the scope of the present invention are polyethylenes commercially available from Allied Chemical and Petrolite Corporation; Epolene N-15, commercially available from Eastman Chemical Products Inc.; Viscol 550P, a low molecular weight polypropylene available from Sanyo Kasei K.K.; and the like. The commercially available polyethylenes selected have a molecular weight of from about 1,000 to about 2,000, while the commercially available polypropylenes incorporated into the toner compositions of the present invention are of a molecular weight of about 4,000 to about 5,000. Many of the polyethylene and polypropylene compositions useful in the present invention are illustrated in British Pat. No. 1,442,835, the disclosure of which is totally incorporated herein by reference.

Further, the aforementioned low molecular weight wax materials can be incorporated into the toner compositions in various amounts; however, generally these waxes are present in an amount from about 1 percent by weight to about 10 percent by weight, and preferably are present in an amount of from about 2 percent by weight to about 5 percent by weight. The blended charge enhancing additives are present in an amount of from about 0.5 percent to about 20 percent by weight, and preferably from about 1 percent by weight to about 5 percent by weight based on the total weight of the toner particles. Other amounts of waxes, and charge enhancing additives can be selected providing the objectives of the present invention are achievable.

The first and second resin particles can be admixed in various effective amounts, however, generally from about 10 to about 30 percent by weight of the second crosslinked toner resin particles are blended with from about 70 percent to about 90 percent by weight of the first toner resin particles. Further, toner compositions comprised of the aforementioned first resin particles and second resin particles can be prepared by many known methods including melt blending of the resin particles, colored pigment particles, charge enhancing additives, and low molecular weight wax components.

Formulation of developers requires admixing with the aforementioned toner compositions carrier particles that will enable the toner particles to become positively charged. Accordingly, as carrier cores there can be selected steel, nickel, iron ferrites and the like, with coatings thereover of fluoropolymers, such as polyvinylidene fluoride, copolymers of tetrafluoroethylenes and vinyl chloride. Additionally, there can be selected nickel berry carriers as described in U.S. Pat. Nos. 3,847,604 and 3,767,598, the disclosures of which are totally incorporated herein by reference. The diameter of the coated carrier particles is from about 50 microns to about 1,000 microns thus permitting the carrier particles to possess sufficient density and inertia to avoid adherence to the electrostatic images during the development process.

The carrier particles are mixed with the toner composition in various suitable combinations, however, best results are obtained with from about 1 part by weight of toner particles to about 3 parts by weight of toner particles, to about 100 parts to 200 parts by weight of carrier particles.

As indicated hereinbefore, the toner and developer compositions of the present invention are very useful for developing colored electrostatic latent images, particularly those present on an imaging member charged negatively. When employing the developing compositions of the present invention, it is not necessary to utilize a release fluid, such as a silicone oil, to present toner offset since the compositions of the present invention prevent toner offset without such a toner release fluid.

Examples of imaging surfaces that may be selected include various known photoreceptor compositions, particularly those which are negatively charged, which usually occurs with organic photoreceptors including layered photoreceptors. Illustrative examples of layered photoresponsive devices are comprised of a generating layer, and a transport layer, as described in U.S. Pat. No. 4,265,990, the disclosure of which is totally incorporated herein by reference. Examples of generating pigments are trigonal selenium, metal phthalocyanines, metal free phthalocyanines, and vanadyl phthalocyanine. Transport materials that may be selected include various aryl diamines dispersed in resinous binders.

The imaging method of the present invention thus involves the formation of a negatively charged electrostatic latent image on a suitable imaging member, contacting the image with the colored developer composition of the present invention comprised of toner particles and carrier particles, wherein the toner particles contain resin particles, pigment particles, a charge enhancing additive and a low molecular weight wax; followed by transferring the developed colored image to a suitable substrate such as paper; and permanently affixing the image thereto by various suitable means such as heat.

The following examples are being supplied to further define specific embodiments of the present invention, it being noted that these examples are intended to illustrate and not limit the scope of the present invention. Parts and percentages are by weight unless otherwise indicated.

EXAMPLE I

There was prepared by melt blending in a Banbury mixing device, maintained at 120° C., followed by mechanical attrition, a toner composition with 65.5 percent by weight of a styrene butadiene copolymer available as Pliolite from Goodyear Chemical, 18 percent by weight of a styrene n-butylmethacrylate copolymer 58/42, crosslinked with 0.2 percent by weight of divinyl benzene, 5 percent by weight of the low molecular weight wax polypropylene commercially available as Viscol 550P from Sanyo Corporation, 1.5 percent by weight of distearyl dimethyl ammonium methyl sulfate, and 10 percent by weight of the magenta pigment, available as Hostaperm Pink.

There was also prepared by melt blending in a Banbury mixing device, maintained at 120° C., followed by mechanical attrition, a toner composition with 62.5 percent by weight of a styrene butadiene copolymer available as Pliolite from Goodyear Chemical; 21 percent by weight of a styrene n-butylmethacrylate copolymer, 58/42, crosslinked with 0.2 percent by weight of divinyl benzene; 5 percent by weight of the low molecular weight wax polypropylene commercially available as Viscol 550P from Sanyo Corporation; 1.5 percent by weight of distearyl dimethyl ammonium methyl sulfate; and 10 percent by weight of Sudan Blue pigment.

There was also prepared by melt blending in a Banbury mixing device, maintained at 120° C., followed by mechanical attrition, a third toner composition with 62.5 percent by weight of a styrene butadiene copolymer available as Pliolite from Goodyear Chemical; 21 percent by weight of a styrene n-butylmethacrylate copolymer; 58/42, crosslinked with 0.2 percent by weight of divinyl benzene; 5 percent by weight of the low molecular weight wax polypropylene commercially available as Viscol 550P from Sanyo Corporation; 1.5 percent by weight of distearyl dimethyl ammonium methyl sulfate; and 9.6 percent by weight of Litho Scarlet pigment.

The triboelectric charge present on the above-prepared toner compositions was then determined after mixing each toner, 1 part by weight with 100 parts by weight of carrier particles consisting of a steel core coated with 1.25 percent by weight of a copolymer of trifluoroethylene, and vinyl chloride (FPC 461) by examining the charge level on a toner charge spectrograph. This known instrument disperses toner particles in proportion to the charge to diameter ratio, and with the aid of automated microscopy can generate charge distribution histograms for selected toner size classes. Each of these toner compositions possessed triboelectric charges of about 1 femtocoulombs per micron.

EXAMPLE II

There was prepared the following four toner compositions by repeating the procedure of Example I, which toner compositions possess the properties illustrated in Table I:

1: 58.5 percent by weight of Pliolite, 20 percent by weight of a styrene n-butylmethacrylate copolymer (58/42), crosslinked with 0.2 percent by weight of divinyl benzene, 1.5 percent by weight of distearyl dimethyl ammonium methyl sulfate, and 20 percent by weight of a Hostaperm magenta predispersion.

2: 53.5 percent by weight of Pliolite, 20 percent by weight of a crosslinked styrene n-butylmethacrylate copolymer resin (58/42), crosslinked with 0.2 percent by weight of divinyl benzene, 1.5 percent by weight of distearyl dimethyl ammonium methyl sulfate, 20 percent by weight of a Hostaperm magenta dispersion, and 5 percent by weight of polypropylene wax available as Viscol 550P.

3: 63.0 percent by weight of Pliolite, 21 percent by weight of a crosslinked styrene n-butylmethacrylate copolymer resin (58/42), crosslinked with 0.2 percent by weight of divinyl benzene, 1.0 percent by weight of distearyl dimethyl ammonium methyl sulfate, 10 percent by weight of Sudan Blue, and 5 percent by weight of polypropylene wax available as Viscol 550P.

4: 62.1 percent by weight of Pliolite, 21 percent by weight of a styrene n-butylmethacrylate copolymer (58/42), crosslinked with 0.2 percent by weight of divinyl benzene, 1.5 percent by weight of distearyl dimethyl ammonium methyl sulfate, 0.8 percent by weight of a Hostaperm magenta predispersion, 9.6 percent by weight of Litho Scarlet, and 5 percent by weight of polypropylene wax available as Viscol 550P.

TABLE I

| Toner Composition | MFT* °F. | Hot Offset °F. | Release Characteristics |
|---|---|---|---|
| 1 | 330 | about 370 | poor |
| 2 | 330 | greater than 425 | excellent |
| 3 | 330 | greater than 425 | excellent |
| 4 | 330 | greater than 425 | excellent |

*Minimum Fix Temperature

1. The designation MFT represents the minimum temperature required to produce an acceptable toner fix to paper.
2. The difference between the MFT, the minimum fix temperature, and the temperature at which toner begins to stick to the fuser roll is the fusing latitude. An acceptable fusing latitude would be about 50° C. The fusing experiments were performed in the Xerox 1075 ® copier fuser assembly. This fuser assembly did not contain silicone oil.
3. By very poor release characteristics is meant that the toner offsets and transfers to the fuser roll, which toner will eventually deposit on paper containing the electrostatic latent image. Additionally, in some instances, toner deposits on the fuser roll will cause paper to stick to the roll. In contrast, excellent release characteristics result in substantially no toner being deposited on the fuser roll of the commercially available Xerox Corporation 1075 ® fuser assembly. Also, excellent release characteristics are characterized by toners 2, 3 and 4 with fusing latitudes of greater than 50° F. with very little, if any, toner accumulation occuring on the 1075 ® fuser assembly after extended copy throughput, over 10,000 copy cycles.

4. The Pliolite resins were commercially obtained from Goodyear as Goodyear S5A, styrene butadiene copolymer resins.

Developer compositions were prepared by mixing 1 part by weight of the toner compositions designated 2, 3, and 4 in Table I, which toner compositions were comprised of the polymer, charge enhancing additive and low molecular weight wax in the proportions listed with 100 parts by weight of a carrier material consisting of a ferrite core coated with 0.8 percent by weight of a polychlorotrifluoroethylene-covinylchloride copolymer commercially available as FPC 461.

Each of these developer compositions were then utilized in a xerographic imaging test apparatus wherein the photoreceptor was comprised of a trigonal selenium generating layer in contact with an amine transport layer of N,N'-diphenyl-N'-bis(3-methylphenyl)-[1,1'-diphenyl]-4,4-diamine dispersed in a polycarbonate resinous binder, which photoreceptor is prepared as disclosed in U.S. Pat. No. 4,265,990 and is charged negatively. There is immediately obtained after one imaging cycle, colored cyan, blue and magenta images of high quality and excellent resolution, with substantially no background deposits.

Furthermore, in the Xerox Corporation 1075 ® imaging test fixture, with no silicone release oil present therein, there resulted developed images wherein no smearing or smudging was observed by finger rubbing; and further, no offsetting of the images occurred beginning with the first imaging cycle and continuing on to 10,000 imaging cycles with each of these developer compositions.

Toner and developer compositions other than those specified herein can also be prepared, for example, a further toner composition can be prepared by repeating the procedure of Example I with the exception that there was selected as the first resin particles a styrene n-butyl methacrylate copolymer, 58 percent by weight of styrene and 42 percent by weight of n-butyl methacrylate.

Other modifications of the present invention will occur to those skilled in the art based upon a reading of the present disclosure. These are intended to be included within the scope of this invention.

What is claimed is:

1. An improved positively charged dry electrostatic colored toner composition consisting essentially of first from about 70% by weight to about 90% by weight of resin particles; from about 10% by weight to about 30% by weight of crosslinked second resin particles; colored pigment particles excluding black; and selected from the group consisting of cyan, magenta, yellow, blue, red, and brown; a low molecular weight wax of a molecular weight of from 500 to about 20,000; and a charge enhancing additive selected from the group consisting of alkyl pyridinium halides, organic sulfonate compositions and organic sulfate compositions of the following formulas:

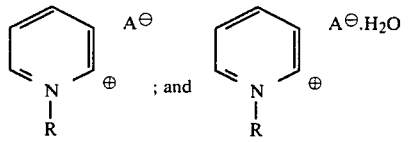

I.

wherein R is a hydrocarbon group containing from about 8 to about 22 carbon atoms, and A is an anion;

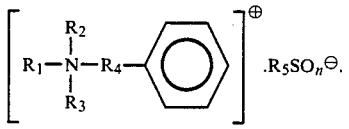

II.

wherein $R_1$ is an alkyl group of from about 12 carbon atoms to about 22 carbon atoms, $R_2$ and $R_3$ are independently selected from alkyl groups containing from about 1 carbon atom to about 5 carbon atoms, $R_4$ is an alkylene group of from about 1 carbon atom to about 5 carbon atoms, $R_5$ is a tolyl group or an alkyl group of from about 1 carbon atom to about 3 carbon atoms, and n is the number 3 or 4; and distearyl dimethyl ammonium methyl sulfate, behenyl trimethyl ammonium methyl sulfate, and distearyl methyl ethyl ammonium ethyl sulfate.

2. A toner composition in accordance with claim 1 wherein the resin particles are selected from the group consisting of polyesters, styrene butadiene copolymers, or styrene methacrylate copolymers.

3. A toner composition in accordance with claim 2 wherein the polyester results from the condensation reaction of dimethyl terephthalate, 1,3-butanediol, and pentaerythritol.

4. A toner composition in accordance with claim 2 wherein the styrene butadiene copolymer contains 89 percent by weight of styrene, and 11 percent by weight of butadiene.

5. A toner composition in accordance with claim 1 wherein the wax is selected from the group consisting of polyethylene and polypropylene.

6. A toner composition in accordance with claim 5 wherein the polyethylene or polypropylene are present in an amount of from about 1 percent by weight to about 10 percent by weight.

7. A toner composition in accordance with claim 1 wherein the charge enhancing additive is cetyl pyridinium chloride.

8. A toner composition in accordance with claim 1 wherein the charge enhancing additive is stearyl dimethyl phenethyl ammonium paratoluene sulfonate.

9. A toner composition in accordance with claim 1 wherein the wax is of a molecular weight of from about 500 to about 20,000.

10. A toner composition in accordance with claim 1 wherein the charge enhancing additive is present in an amount of from about 0.5 percent by weight to about 20 percent by weight.

11. A toner composition in accordance with claim 1 wherein the colored pigment particles are selected from the group consisting of cyan, magenta, yellow, red, blue, green and mixtures thereof, present in an amount of from about 2 to about 15 percent by weight.

12. A toner composition in accordance with claim 1 wherein the second resin particles are crosslinked with a divinyl benzene.

13. A developer composition comprised of the toner composition of claim 1 and carrier particles.

14. A developer composition in accordance with claim 13 wherein the carrier particles contain a coating thereover.

15. A developer composition in accordance with claim 13 wherein the carrier particles consist of a steel core coated with a fluoropolymer.

16. A developer composition in accordance with claim 13 wherein the colored pigment particles are selected from the group consisting of cyan, magenta, yellow, red, blue, brown, green and mixtures thereof, present in an amount of from about 2 to about 15 percent by weight.

17. A method for developing images which comprises forming an electrostatic latent image on a negatively charged imaging member, contacting the image with the toner composition of claim 1, followed by transferring the image to a suitable substrate, and permanently affixing the image thereto.

18. A method of imaging in accordance with claim 17 wherein the wax is selected from the group consisting of polypropylene, polyethylene, or mixtures thereof.

19. A method of imaging in accordance with claim 17 wherein the process is accomplished in the absence of a silicone oil release fluid, and there results no offsetting of the resulting images.

20. A toner composition in accordance with claim 1 wherein R is an alkyl group of from about 12 carbon atoms to about 22 carbon atoms, $R_1$ is an alkyl group of from about 14 carbon atoms to about 18 carbon atoms, and n is the number 3.

21. A toner composition in accordance with claim 1 wherein R is an alkyl group of from about 12 carbon atoms to about 18 carbon atoms, and $R_1$ is an alkyl group of from about 14 carbon atoms to about 18 carbon atoms, and n is the number 4.

22. A toner composition in accordance with claim 1 wherein $R_2$ and $R_3$ are methyl groups.

23. A toner composition in accordance with claim 1 wherein $R_4$ is a methylene group.

24. A developer composition in accordance with claim 13 wherein the resin particles are selected from the group consisting of polyesters, styrene butadiene copolymers and styrene methacrylate copolymers.

25. A developer composition in accordance with claim 13 wherein the wax selected is of a molecular weight of from about 500 to about 20,000.

26. A developer composition in accordance with claim 13 wherein the wax is selected from the group consisting of polypropylene and polethylene.

27. A method of imaging in accordance with claim 17 wherein the resin particles are selected from the group consisting of styrene butadiene copolymers or styrene methacrylate copolymers.

* * * * *